US011920422B2

(12) United States Patent
Tenorio et al.

(10) Patent No.: US 11,920,422 B2
(45) Date of Patent: Mar. 5, 2024

(54) RISER COLLET CONNECTOR SYSTEMS AND METHODS

(71) Applicant: Schlumberger Technology Corporation, Sugar Land, TX (US)

(72) Inventors: Harold Tenorio, Houston, TX (US); John Zahl, Kristiansand (NO); Jon Tyler, Houston, TX (US); Ross Stevenson, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/459,025

(22) Filed: Aug. 27, 2021

(65) Prior Publication Data

US 2023/0069463 A1 Mar. 2, 2023

(51) Int. Cl.

| | |
|---|---|
| ***E21B 17/01*** | (2006.01) |
| ***E21B 17/08*** | (2006.01) |
| ***E21B 19/16*** | (2006.01) |
| ***E21B 33/038*** | (2006.01) |

(52) U.S. Cl.

CPC ..... *E21B 33/038* (2013.01); *E21B 17/01* (2013.01); *E21B 17/085* (2013.01); *E21B 19/16* (2013.01)

(58) Field of Classification Search

CPC ..... E21B 29/12; E21B 17/0853
USPC ..... 166/343, 378
See application file for complete search history.

(56) References Cited

U.S. PATENT DOCUMENTS

| | | | | |
|---|---|---|---|---|
| 4,470,621 | A | 9/1984 | Irvine | |
| 4,491,346 | A | 1/1985 | Walker | |
| 6,419,277 | B1 * | 7/2002 | Reynolds | E21B 17/01 285/123.1 |
| 8,616,286 | B2 * | 12/2013 | Papon | E21B 17/01 166/341 |
| 8,657,013 | B2 * | 2/2014 | Kotrla | E21B 17/01 166/345 |
| 8,800,666 | B2 * | 8/2014 | Guesnon | E21B 17/1035 166/359 |
| 8,863,846 | B2 * | 10/2014 | Overstreet | E21B 19/086 166/85.1 |
| 9,334,705 | B1 | 5/2016 | Ward et al. | |
| 9,650,855 | B2 * | 5/2017 | Caldwell | E21B 33/038 |
| 9,657,536 | B2 * | 5/2017 | Weir | E21B 17/0853 |
| 2009/0308658 | A1 * | 12/2009 | Larson | E21B 17/085 175/57 |

(Continued)

FOREIGN PATENT DOCUMENTS

| | | | |
|---|---|---|---|
| WO | 2013152187 | A3 | 5/2014 |
| WO | 2014179538 | A1 | 11/2014 |

(Continued)

OTHER PUBLICATIONS

Combined Search and Exam Report issued in United Kingdom Patent Application No. GB2212516.5 dated Jan. 25, 2023, 7 pages.

*Primary Examiner* — Matthew Troutman
*Assistant Examiner* — Douglas S Wood

(57) ABSTRACT

A connector system includes a first riser joint configured to form part of a riser. The first riser joint includes a pin. The connector system also includes a connector configured to couple to a wellhead assembly. The connector includes multiple collet segments that are configured to move radially-inwardly to engage the pin of the first riser joint.

20 Claims, 6 Drawing Sheets

(56) References Cited

U.S. PATENT DOCUMENTS

| | | | | |
|---|---|---|---|---|
| 2012/0222865 | A1* | 9/2012 | Larson | E21B 17/085 166/345 |
| 2014/0209316 | A1 | 7/2014 | Tindle et al. | |
| 2018/0258728 | A1 | 9/2018 | Zonoz et al. | |
| 2018/0298698 | A1 | 10/2018 | Garro et al. | |
| 2020/0025230 | A1 | 1/2020 | Harrop et al. | |

FOREIGN PATENT DOCUMENTS

| | | | |
|---|---|---|---|
| WO | 2017105427 | A1 | 6/2017 |
| WO | 2018187722 | A1 | 10/2018 |
| WO | 2018187726 | A1 | 10/2018 |
| WO | 2021091555 | A1 | 5/2021 |

* cited by examiner

RISER COLLET CONNECTOR SYSTEMS AND METHODS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity. Once a desired resource is discovered below the surface of the earth, a drilling system is often employed to access the desired resource. A subsea drilling system may include a riser that extends between a wellhead assembly at a sea floor and a platform (e.g., drilling rig or surface vessel) at a sea surface. The riser is fluidly coupled to the wellhead assembly to enable the riser to carry fluid (e.g., drilling mud) from the wellhead assembly toward the platform.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is generally directed to a connector system that is configured to couple a riser of a subsea drilling system to a wellhead assembly (e.g., to a lower marine riser package [LMRP] of the wellhead assembly). For example, the connector system may include a pin (e.g., pin section; extension) at a first end (e.g., distal end) of the riser, and a connector (e.g., collet connector) coupled to the wellhead assembly. The pin may be inserted into the connector, and movable components (e.g., collet segments) of the connector may move (e.g., radially-inwardly) to engage the pin at the first end of the riser.

Advantageously, the pin at the first end of the riser may stab into the connector to efficiently form a connection between the riser and the wellhead assembly, and the pin at the first end of the riser may be withdrawn from the connector to efficiently break up the connection between the riser and the wellhead assembly. While certain embodiments disclosed herein relate to the connector system to couple the riser to the wellhead assembly in off-shore (e.g., subsea) systems, it should be understood that the connector system may be adapted to couple other tubular components to one another in off-shore systems and/or in on-shore (e.g., land-based) systems.

Figure 1:
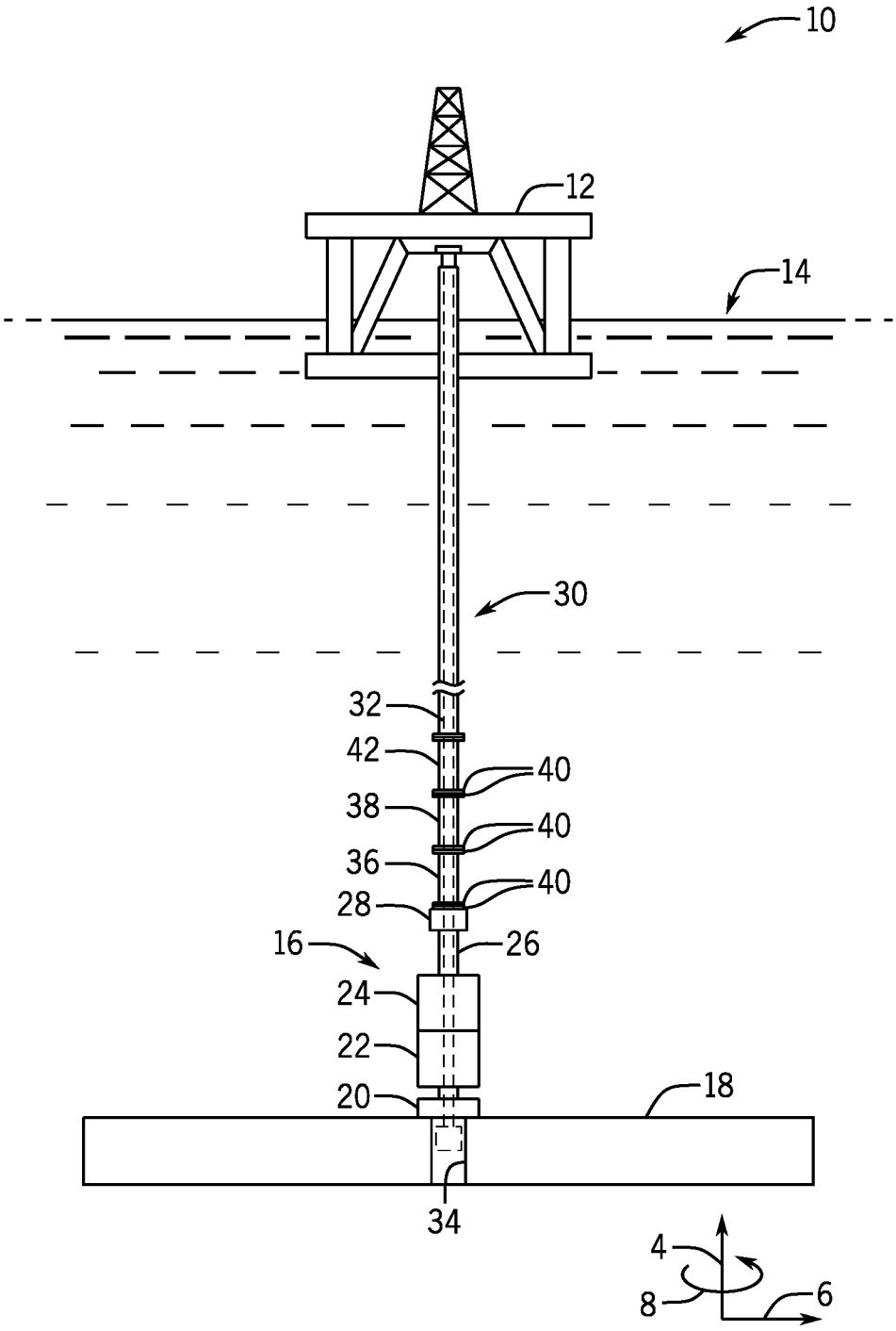
FIG. 1 is a schematic diagram of a subsea drilling system, in accordance with an embodiment of the present disclosure.

FIG. 1 is an embodiment of a subsea drilling system 10. To facilitate discussion, the subsea drilling system 10 and its components may be described with reference to an axial axis or direction 4, a radial axis or direction 6, and a circumferential axis or direction 8. As shown, the subsea drilling system 10 includes an offshore drilling rig or platform 12 at a sea surface 14 and a wellhead assembly 16 positioned at a sea floor 18. The wellhead assembly 16 includes a wellhead 20, a blowout preventer (BOP) stack 22, and a lower marine riser package (LMRP) 24. The BOP stack 22 may include one or more ram BOPs and the LMRP 24 may include one or more annular BOPs. The LMRP 24 may also include or be coupled to a joint 26 (e.g., flex joint), which may include or be coupled to (e.g., via fasteners, such as threaded fasteners) a connector 28 (e.g., collet connector).

The connector 28 may be configured to receive and to couple (e.g., physically and fluidly couple) to a riser 30 (e.g., a drilling riser; tubular structure), which extends from the connector 28 toward the platform 12. Drilling operations may be carried out by a drill string 32 (e.g., tubular string) that extends from the platform 12, through the riser 30, through the connector 28, through the wellhead assembly 16, and into a wellbore 34. During drilling operations, drilling mud may flow through the drill string 32, and the drilling mud may exit through openings at a distal end of the drill string 32 to facilitate drilling the wellbore 34. The drilling mud and cuttings from the wellbore 34 may then flow toward the platform 12 through an annular space defined between the drill string 32 and the riser 30. As shown, the riser 30 may be formed from multiple riser joints that are stacked end-to-end and that are coupled to one another via fasteners that extend through flanges. For example, the riser 30 may include a first riser joint 36 that contacts and connects to the connector 28 (e.g., stabs into the connector 28), a second riser joint 38 that connects to the first riser joint 36 via fasteners that extend through flanges 40 at adjacent ends of the first riser joint 36 and the second riser joint 38, a third riser joint 42 that connects to the second riser joint 38 via fasteners that extend through flanges 40 at adjacent ends of the second riser joint 38 and the third riser joint 42, and so on. As shown, the first riser joint 36 and the connector 28 may also include flanges 40 that are positioned to support the first riser joint 36 at the connector 28 and/or facilitate connection of auxiliary lines (e.g., fluid control lines) that extend along the riser 30. In FIG. 1, only some of the riser joints are shown for image clarity.

It is presently recognized that it would be advantageous to provide a collet connection between the connector 28 and the riser 30 to enable efficient coupling and decoupling operations. As discussed in detail herein, the collet connection may be formed between movable components (e.g., collet segments) of the connector 28 and a pin (e.g., annular pin; extension) at a first end (e.g., distal end) of the riser 30.

Figure 2:
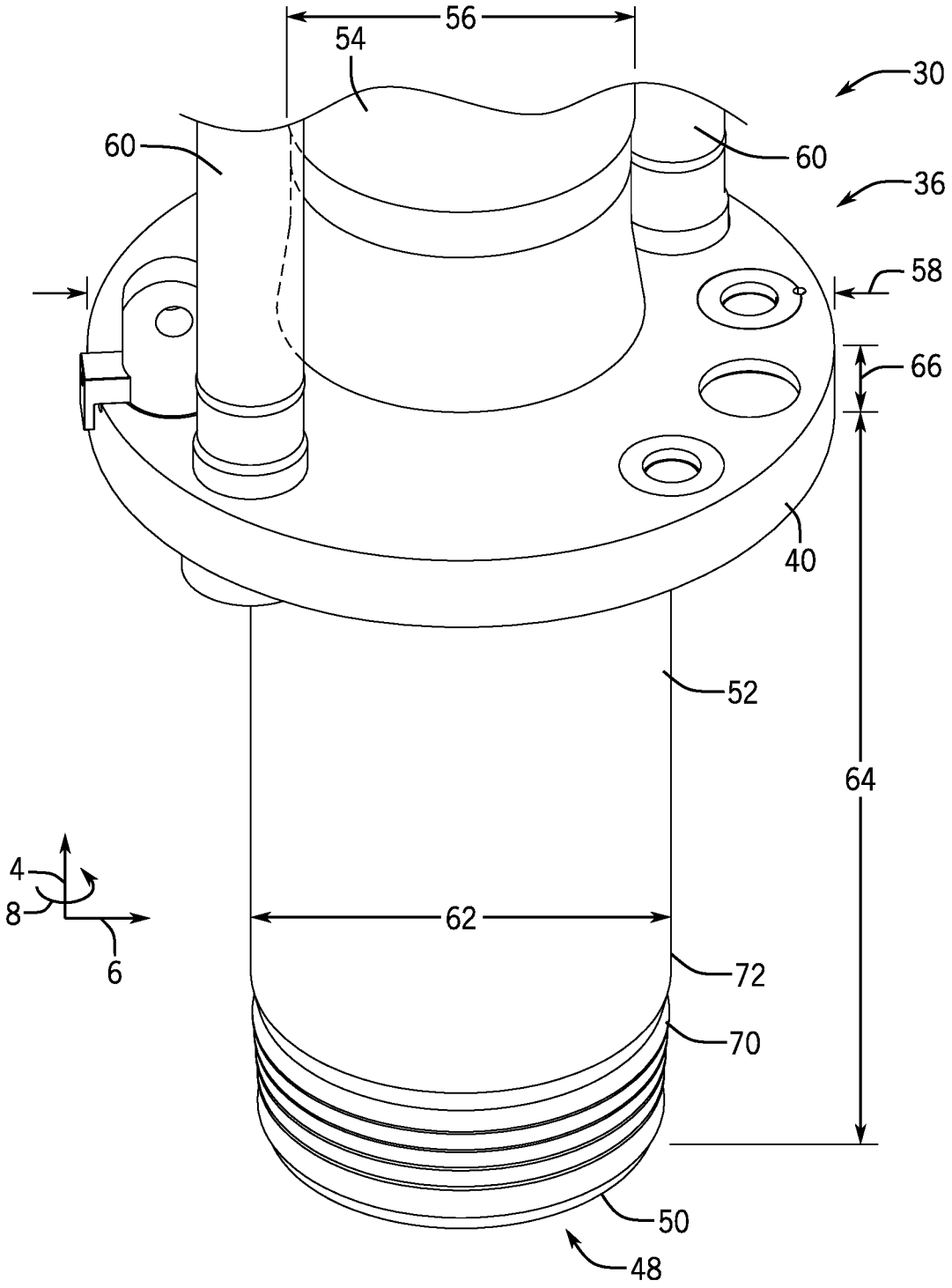
FIG. 2 is a perspective view of a portion of a riser that may be used in the subsea drilling system, in accordance with an embodiment of the present disclosure.
Figure 3:
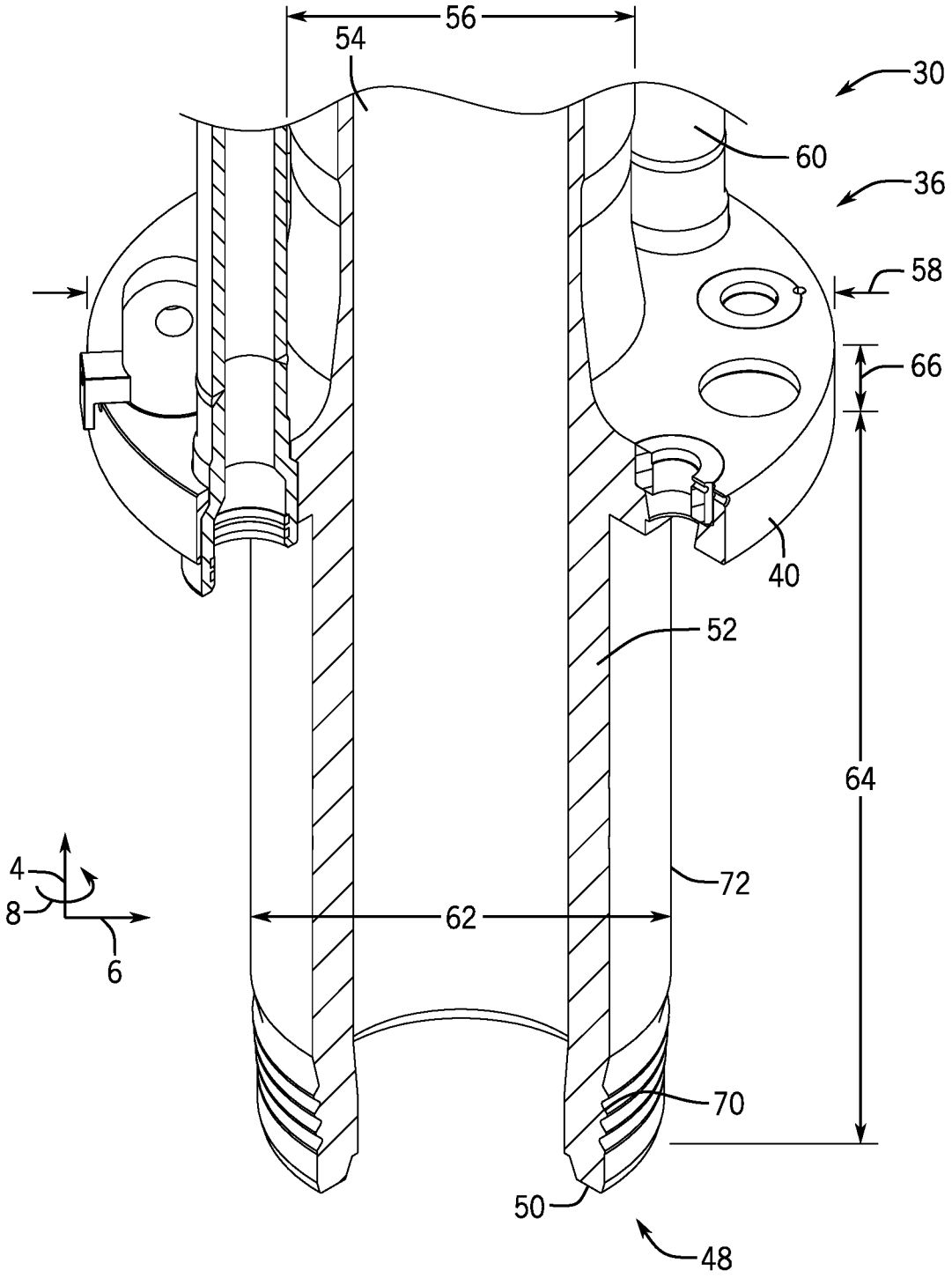
FIG. 3 is a cross-sectional perspective view of the portion of the riser, in accordance with an embodiment of the present disclosure.

FIGS. 2 and 3 are a perspective view and a cross-sectional perspective view, respectively, of an embodiment of a portion of the riser 30. In particular, the portion of the riser 30 includes a portion of the first riser joint 36 that is configured to connect to the connector 28 of FIG. 1. The first riser joint 36 forms a first end 48 (e.g., distal end) of the riser 30, and the first riser joint 36 extends from a first end 50 (e.g., distal end) to a second end (e.g., proximal end that connects to the second riser joint 38 shown in FIG. 1).

The first riser joint 36 may include the flange 40, a pin 52 (e.g., pin section), and a main body 54 (e.g., main riser section). The main body 54 may extend from the second end of the first riser joint 36 to the flange 40. The main body 54 may be an upper tubular section with a main body diameter 56, and the flange 40 may be a radially-expanded section with a flange diameter 58 that is greater than the main body diameter 56. As shown, multiple openings are distributed circumferentially about the flange 40 to support auxiliary lines 60 (e.g., fluid control lines).

The pin 52 may be a lower tubular section with a pin diameter 62 that is less than the flange diameter 58. The pin diameter 62 may be the same as or different than (e.g., larger or smaller) the main body diameter 56. The pin 52 may also have a pin height 64 that is greater (e.g., at least 2, 3, 4, 5, 10, or more times greater) than a flange height 66 of the flange 40. The pin height 64 may be the same as or different than (e.g., greater or smaller) a main body height of the main body 54 (e.g., from the flange 40 and the second end of the first riser joint 36). For example, the pin height 64 may be at least 2, 3, 4, 5, 10, or more times greater than the main body height, or the main body height may be no more than 2, 3, 4, 5, 10, or more times greater than the pin height 64) The pin 52 may include one or more annular grooves 70 formed in a radially-outer surface 72 of the pin 52 proximate to (e.g., at or near) the first end 50 of the first riser joint 36. The one or more grooves 70 (e.g., annular grooves) may facilitate coupling the first riser joint 36 to the connector 28 of FIG. 1. It should be appreciated that the one or more grooves 70 may have any suitable position and/or arrangement to facilitate coupling the first riser joint 36 to the connector 28 of FIG. 1. It should also be appreciated that the flange 40, the pin 52, and/or the main body 54 may be formed as one-piece (e.g., via additive manufacturing) and/or may be coupled to one another in any of a variety of manners (e.g., welds). Furthermore, only the first riser joint 36 may include the pin 52 (e.g., the other riser joints, such as the second riser joint and the third riser joint, may not include the pin 52 that extends vertically below the flange 40).

Figure 4:
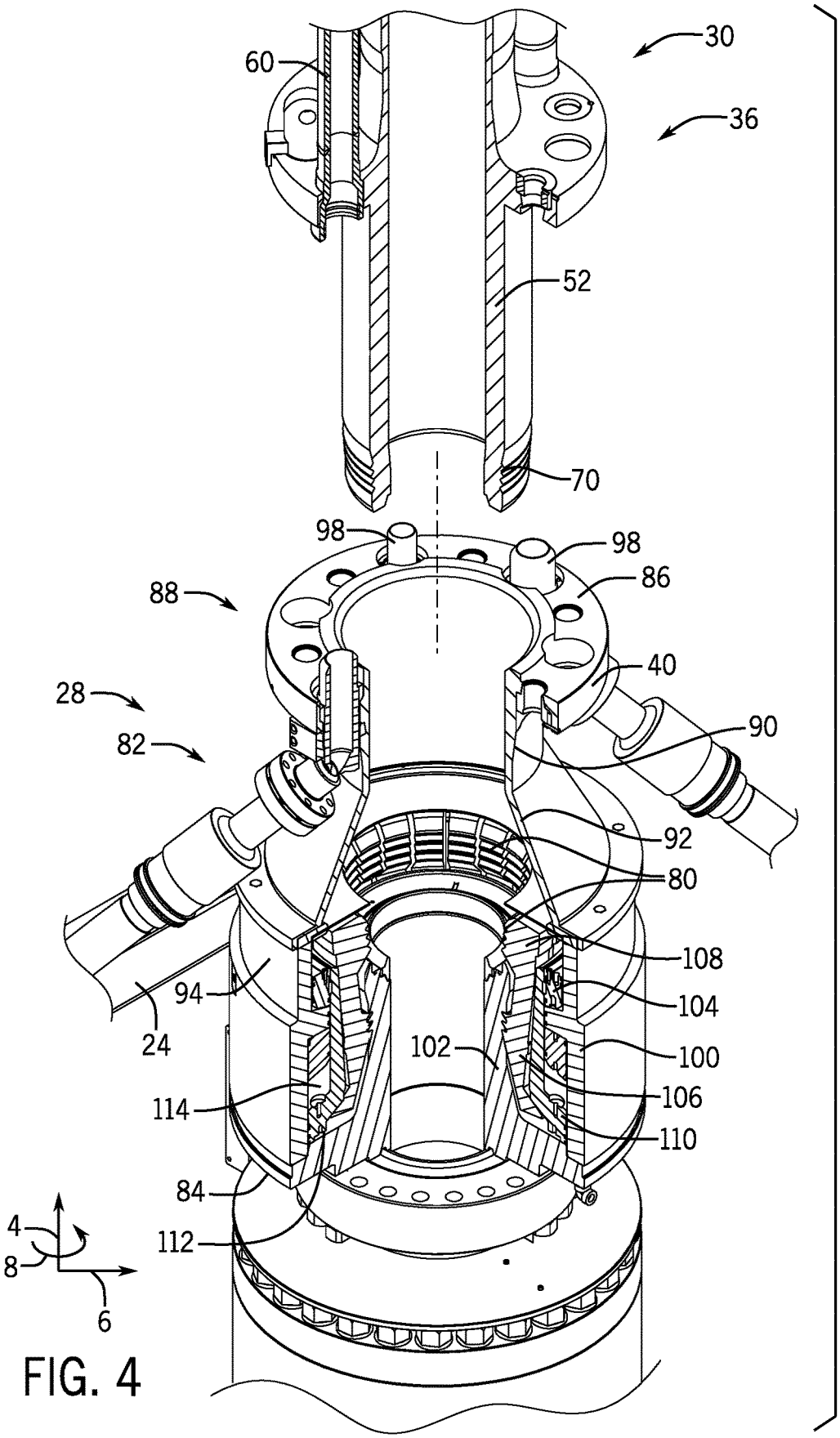
FIG. 4 is a cross-sectional perspective view of the portion of the riser of and a connector of a lower marine riser package (LMRP), wherein the connector is in an open configuration, in accordance with an embodiment of the present disclosure.

FIG. 4 is a cross-sectional perspective view of the portion of the riser 30 (e.g., the portion of the first riser joint 36) and the connector 28 of the LMRP 24, wherein the connector 28 is in an open configuration (e.g., unlocked configuration). As shown, the connector 28 may be in the open configuration as the first riser joint 36 moves toward (e.g., is lowered toward) the connector 28. In the open configuration, collet segments 80 of the connector 28 are in an expanded position (e.g., radially-expanded position) that enables the collet segments 80 to be positioned about and/or to receive the pin 52 of the first riser joint 36 within an opening defined by the collet segments 80. Furthermore, in the open configuration, the connector 28 does not engage and/or is not locked to the pin 52 of the first riser joint 36.

As shown, the connector 28 includes a connector body 82 that extends from a first end 84 (e.g., distal end) to a second end 86 (e.g., proximal end). The connector body 82 may also include the flange 40 at the second end 86, a neck 88 (e.g., neck section) with a cylindrical neck portion 90 and a tapered neck portion 92, and a collet housing 94 (e.g., collet section). The flange 40 may be a radially-expanded section with multiple openings distributed circumferentially about the flange 40 to support the auxiliary lines 60 and/or to support line connectors 98 that are configured to couple (e.g., fluidly couple; via a stab connection) to the auxiliary lines 60. The cylindrical neck portion 90 of the neck 88 may have an inner diameter that is larger (e.g., slightly larger) than an outer diameter of the pin 52 so as to align/guide the pin 52 into the opening defined by the collet segments 80 and/or to block radial movement of the pin 52 after insertion of the pin 52 into the connector 28. The tapered neck portion 92 may taper radially outwardly to join the cylindrical neck portion 90 to the collet housing 94, which has a collet housing diameter that is greater than a cylindrical neck portion diameter of the cylindrical neck portion 90.

The collet housing 94 includes an outer wall 100 (e.g., annular wall; outer sleeve) and an inner wall 102 (e.g., annular wall; inner sleeve). An annular space 104 is defined between the outer wall 100 and the inner wall 102. As shown, lower portions 106 of the collet segments 80 are positioned to form a ring (e.g., segmented ring) in the annular space 104, while upper portions 108 of the collet segments 80 are positioned vertically above the inner wall 102 to enable the upper portions 108 of the collet segments 80 to engage the one or more grooves 70 of the first riser joint 36.

A piston 110 (e.g., annular piston) is also positioned in the annular space 104, and upward movement of the piston 110 within the collet housing 94 (e.g., relative to the collet segments 80) causes the piston 110 to drive the upper portions 108 of the collet segments 80 radially-inwardly to adjust the collet segments 80 from the expanded position to a collapsed position (e.g., radially-collapsed position) to enable the upper portions 108 of the collet segments 80 to engage the pin 52 of the first riser joint 36. Similarly, downward movement of the piston 110 within the collet housing 94 (e.g., relative to the collet segments 80) causes the piston 110 to drive the upper portions 108 of the collet segments 80 radially-outwardly to adjust the collet segments 80 from the collapsed position to the expanded position to enable the upper portions 108 of the collet segments 80 to receive the pin 52 of the first riser joint 36 and/or to enable withdrawal of the pin 52 of the first riser joint 36 from the connector 28. To adjust the piston 110 upward within the collet housing 94 to thereby drive the upper portions 108 of the collet segments 80 radially-inwardly, a fluid may be provided to a first sealed space 112 within the annular space 104. To drive the piston 110 downward within the collet housing 94 to thereby drive the upper portions 108 of the collet segments 80 radially-outwardly, a fluid may be provided to a second sealed space 114 withing the annular space 104. The fluid may be provided via a fluid supply of the LMRP 24 or the BOP stack 22 of FIG. 1.

Figure 5:
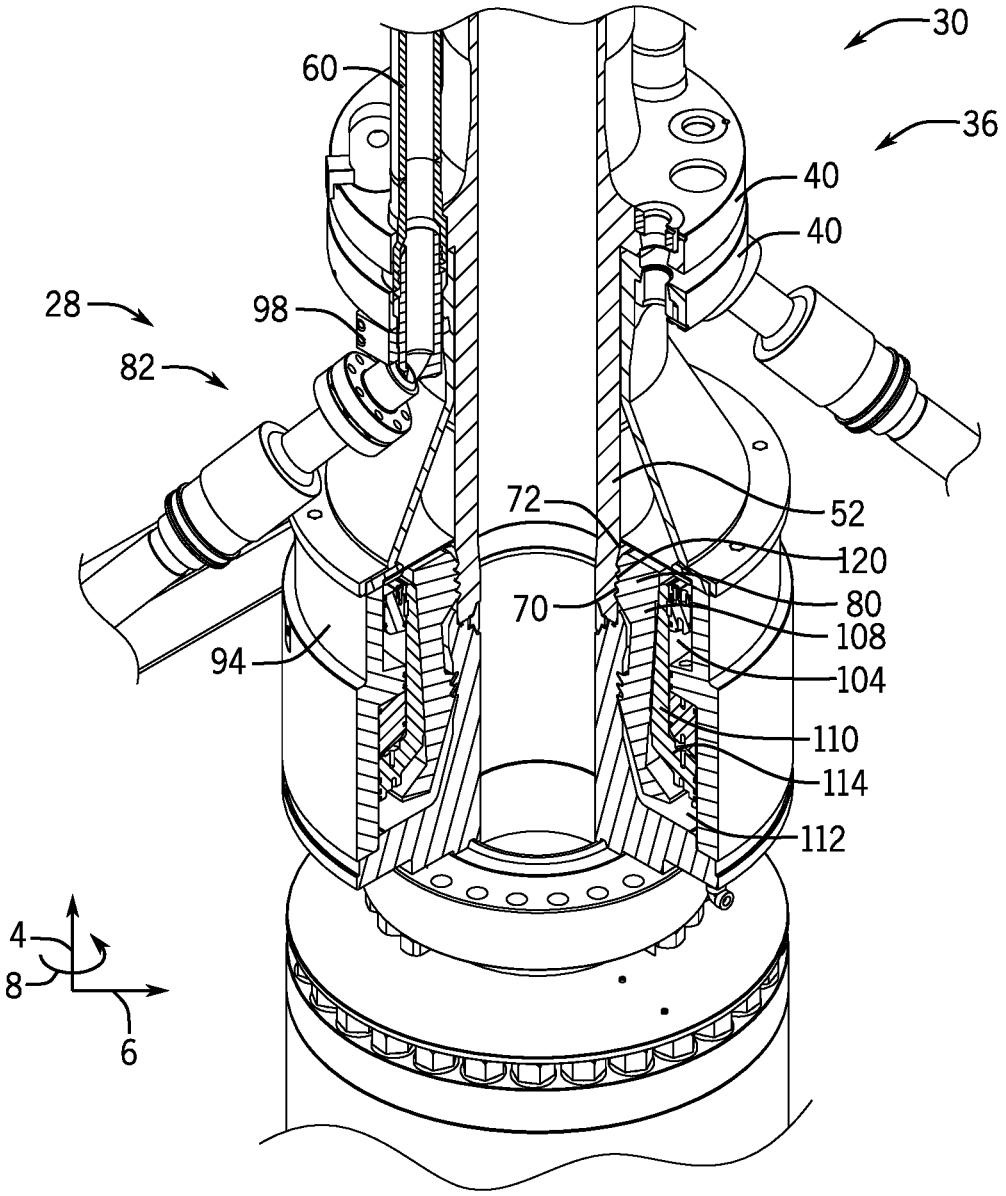
FIG. 5 is a cross-sectional perspective view of the portion of the riser of and the connector of the LMRP, wherein the connector is in a closed configuration, in accordance with an embodiment of the present disclosure.

FIG. 5 is a cross-sectional perspective view of the portion of the riser 30 (e.g., the portion of the first riser joint 36) and the connector 28 of the LMRP 24, wherein the connector 28 is in a closed configuration (e.g., locked configuration). In operation, the connector 28 may be adjusted from the open configuration of FIG. 4 to the closed configuration FIG. 5 after the first riser joint 36 reaches the opening defined by the collet segments 80.

In the closed configuration, the collet segments 80 are in the collapsed position that enables the collet segments 80 to contact and engage the pin 52 of the first riser joint 36. In particular, in the closed configuration, respective radially-inner surfaces 120 of the upper portions 108 of the collet segments 80 contact and engage the one or more grooves 70 formed in the radially-outer surface 72 of the pin 52 of the first riser joint 36, thereby locking the connector 28 to the first riser joint 36 and blocking movement of the connector 28 relative to the first riser joint 36.

As noted herein, upward movement of the piston 110 within the collet housing 94 causes the piston 110 to drive the upper portions 108 of the collet segments 80 radially-inwardly to adjust the collet segments 80 from the expanded position to the collapsed position to enable the upper portions 108 of the collet segments 80 to engage the pin 52 of the first riser joint 36. Similarly, downward movement of the piston 110 within the collet housing 94 causes the piston 110 to drive the upper portions 108 of the collet segments 80 radially-outwardly to adjust the collet segments 80 from the collapsed position to the expanded position to enable the upper portions 108 of the collet segments 80 to receive the pin 52 of the first riser joint 36 and/or to enable withdrawal of the pin 52 of the first riser joint 36 from the connector 28. To adjust the piston 110 upward within the collet housing 94 to thereby drive the upper portions 108 of the collet segments 80 radially-inwardly, the fluid may be provided to the first sealed space 112 within the annular space 104. To drive the piston 110 downward within the collet housing 94 to thereby drive the upper portions 108 of the collet segments 80 radially-outwardly, the fluid may be provided to the second sealed space 114 withing the annular space 104.

As shown, a first vertical distance separates the flange 40 of the first riser joint 36 and the one or more grooves 70 formed in the radially-outer surface 72 of the pin 52 of the first riser joint 36, and a second vertical distance separates the flange 40 of the connector 28 and the upper portions 108 of the collet segments 80. The first vertical distance and the second vertical distance are designed to facilitate vertical alignment between the one or more grooves 70 formed in the radially-outer surface 72 of the pin 52 of the first riser joint 36 and the upper portions 108 of the collet segments 80. In particular, when the flange 40 of the first riser joint 36 contacts the flange 40 of the connector 28 (e.g., at least along radially-inner edges or portions of the flanges 40), the one or more grooves 70 formed in the radially-outer surface 72 of the pin 52 of the first riser joint 36 are in vertical alignment with the upper portions 108 of the collet segments 80. Then, the transition of the collet segments 80 to the collapsed position causes the collet segments 80 to contact and engage the pin 52 of the first riser joint 36. As shown, the auxiliary lines 60 supported by the flange 40 of the first riser joint 36 may also be coupled to the line connectors 98 supported by the flange 40 of the connector 28. In some embodiments, the flange 40 of the first riser joint 36 and the flange 40 of the connector 28 are not fastened to one another via any fasteners (e.g., via threaded fasteners, such as bolts, that extend through respective openings in the flanges 40) while the connection is formed between the first riser joint 36 and the connector 28.

Figure 6:
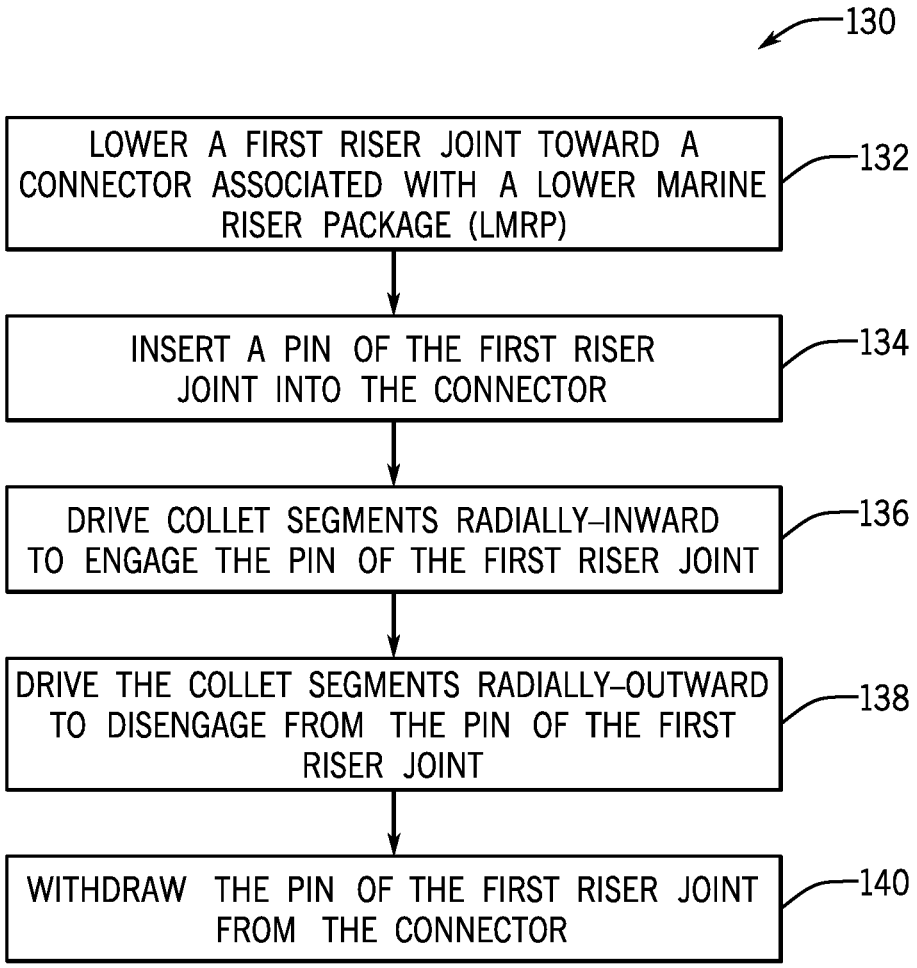
FIG. 6 is a flow diagram of a method of coupling the riser to the LMRP via the connector, in accordance with an embodiment of the present disclosure.

FIG. 6 is a flow diagram of an embodiment of a method 130 for joining the riser 30 to the LMRP 24 via the connector 28. The method 130 includes various steps represented by blocks. It should be noted that some or all of the steps of the method 130 may be performed as an automated procedure by an automated system (e.g., an ROV or an AOV system; a controller on the platform 12 and/or on the wellhead assembly 16) and/or some or all of the steps of the method 130 may be performed manually by an operator (e.g., via controlling the ROV or the AUV; via control inputs to the controller on the platform 12 and/or the wellhead assembly 16). Although the flow chart illustrates the steps in a certain sequence, it should be understood that the steps may be performed in any suitable order and certain steps may be carried out simultaneously, where appropriate. Further, certain steps or portions of the method 130 may be omitted and other steps may be added.

In step 132, the first riser joint 36 of the riser 30 may be lowered toward the connector 28 that is coupled to or included as part of the LMRP 24. As the first riser joint 36 of the riser 30 is lowered toward the connector 28, the collet segments 80 of the connector 28 may be in the expanded position to set the connector 28 in the open configuration that enables the connector 28 to receive the pin 52 of the first riser joint 36 of the riser 30.

In step 134, the pin 52 of the first riser joint 36 of the riser 30 may be inserted into (e.g., stabbed into) the opening defined by the collet segments 80 of the connector 28. As noted herein, when the flange 40 of the first riser joint 36 contacts the flange 40 of the connector 28, the one or more grooves 70 formed in the radially-outer surface 72 of the pin 52 of the first riser joint 36 may be in vertical alignment with the upper portions 108 of the collet segments 80 of the connector 28.

In step 136, the fluid may be provided to the first sealed space 112 to cause upward movement of the piston 110 within the collet housing 94. The upward movement of the piston 110 within the collet housing 94 causes the piston 110 to drive the upper portions 108 of the collet segments 80 radially-inwardly to adjust the collet segments 80 from the expanded position to the collapsed position to enable the upper portions 108 of the collet segments 80 to engage the pin 52 of the first riser joint 36. In this way, the connector 28 may reach the closed configuration in which the connector 28 is locked to the pin 52 of the first riser joint 36.

In step 138, at some later time (e.g., for maintenance operations), the fluid may be provided to the second sealed space 114 to cause downward movement of the piston 110 within the collet housing 94. The downward movement of the piston 110 within the collet housing 94 causes the piston 110 to drive the upper portions 108 of the collet segments 80 radially-outwardly to adjust the collet segments 80 from the collapsed position to the expanded position to enable withdrawal of the pin 52 of the first riser joint 36 from the connector 28.

In step 140, the first riser joint 36 may be withdrawn from the connector 28. Advantageously, the first riser joint 36 and the connector 28 may form a connector system that enables efficient coupling and decoupling between the riser 30 and the LMRP 24. The connection between the first riser joint 36 and the connector 28 may be a sealed connection that fluidly couples the riser 30 and a bore that extends through the wellhead assembly 16. The connection between the first riser joint 36 and the connector 28 may also enable at least some of the riser 30 and at least some of the wellhead assembly 16 to be moved or transported together relative to the wellhead 20. For example, the first riser joint 36 may be coupled to the LMRP 24 and the BOP stack 22 under a rotary table of a moon pool of the platform 12, and then the first riser joint 36, the LMRP 24, and the BOP stack 22 may be lowered toward the wellhead 20 together as one unit.

It should be appreciated that the connector 28 may have any of a variety of configurations, and the collet segments 80 may be driven via an actuator assembly having any of a variety of configurations. For example, instead of the piston 110 being driven upwardly within the collet housing 94 upon supply of the fluid to the first sealed space 112 and downwardly within the collet housing 94 upon supply of the fluid to the second sealed space 114, the piston 110 may be driven downwardly within the collet housing 94 upon supply of the fluid to the second sealed space 114 and upwardly within the collet housing 94 upon release of the fluid from the second sealed space 114. As another example, the collet segments 80 may be biased toward the closed position (e.g., normally closed), but may be driven radially-outwardly via contact with the pin 52 of the first riser joint 36 to receive the pin 52 as the pin 52 moves into the connector 28.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function]. . . " or "step for [perform]ing [a function]. . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A connector system, comprising:

a first riser joint configured to form part of a riser and comprising a pin; and a connector configured to couple to a wellhead assembly and comprising a plurality of collet segments that are configured to move radially-inwardly to engage the pin of the first riser joint, wherein the connector further comprises:

a connector body comprising: a collet housing; a tapered neck portion; and a cylindrical neck portion, wherein the tapered neck portion tapers radially outwardly to join the cylindrical neck portion to the collet housing, the cylindrical neck portion having an inner diameter that is larger than an outer diameter of the pin, wherein the collet housing comprises: an outer wall; an inner wall; and an annular space defined between the outer wall and the inner wall, the connector further comprising: a piston configured to move vertically within the collet housing to drive the plurality of collet segments to move radially-inwardly to engage the pin of the first riser joint, wherein first portions of the plurality of collet segments are positioned to form a ring in the annular space of the collet housing.

2. The connector system of claim 1, wherein the first riser joint comprises:

a main body; and a first riser joint flange positioned between the main body and the pin along a vertical axis of the first riser joint.

3. The connector system of claim 2, wherein the connector comprises a connector flange that is configured to contact the first riser joint flange while the plurality of collet segments engage the pin of the first riser joint.

4. The connector system of claim 2, wherein a pin height of the pin along the vertical axis is at least two times a flange height of the first riser joint flange along the vertical axis.

5. The connector system of claim 1, wherein the first riser joint is configured to support one or more auxiliary lines, and the connector comprises a connector flange that supports one or more line connectors that are configured to couple to the one or more auxiliary lines.

6. The connector system of claim 5, wherein the one or more line connectors are configured to couple to the one or more auxiliary lines via respective stab connections.

7. The connector system of claim 1, wherein second portions of the plurality of collet segments are positioned vertically above the inner wall to enable the second portions of the plurality of collet segments to engage the pin of the first riser joint.

8. A subsea drilling system, comprising:

a riser that extends between a platform at a sea surface and a wellhead assembly at a sea floor, wherein a distal end of the riser comprises a pin; and a connector coupled to the wellhead assembly, wherein the connector comprises:

a plurality of collet segments that are configured to move radially-inwardly to engage the pin to enable the connector to couple the riser to the wellhead assembly;

a connector body comprising: a collet housing; a tapered neck portion; and a cylindrical neck portion, wherein the tapered neck portion tapers radially outwardly to join the cylindrical neck portion to the collet housing, the cylindrical neck portion having an inner diameter that is larger than an outer diameter of the pin;

wherein the collet housing comprises: an outer wall; an inner wall; and an annular space defined between the outer wall and the inner wall, the connector further comprising: a piston configured to move vertically within the collet housing to drive the plurality of collet segments to move radially-inwardly to engage the pin, wherein first portions of the plurality of collet segments are positioned to form a ring in the annular space of the collet housing.

9. The subsea drilling system of claim 8, wherein the riser comprises a plurality of riser joints that are stacked end-to-end, and the plurality of riser joints comprises a first riser joint that forms the distal end of the riser and that comprises the pin.

10. The subsea drilling system of claim 8, wherein the connector is coupled to a lower marine riser package (LMRP) of the wellhead assembly.

11. The subsea drilling system of claim 8, wherein the riser comprises a riser flange that is separated from the distal end of the riser along a vertical axis of the riser.

12. The subsea drilling system of claim 11, wherein the connector comprises a connector flange that is configured to contact the riser flange while the plurality of collet segments engage the pin.

13. The subsea drilling system of claim 12, wherein the riser and the wellhead assembly are connected only via engagement between the plurality of collet segments and the pin, and the connector flange and the riser flange are not coupled to one another via threaded fasteners.

14. The subsea drilling system of claim 11, wherein a pin height of the pin along the vertical axis is at least two times a flange height of the riser flange along the vertical axis.

15. The subsea drilling system of claim 8, wherein second portions of the plurality of collet segments are positioned vertically above the inner wall to enable the second portions of the plurality of collet segments to engage the pin.

16. A method of coupling a riser and a wellhead assembly, the method comprising:

moving a first riser joint of the riser toward a connector coupled to a portion of the wellhead assembly, the connector comprising: a connector body comprising: a collet housing; a tapered neck portion; and a cylindrical neck portion, wherein the tapered neck portion tapers radially outwardly to join the cylindrical neck portion to the collet housing;

inserting a pin of the first riser joint of the riser into an opening defined by a plurality of collet segments of the connector, the cylindrical neck portion having an inner diameter that is larger than an outer diameter of the pin so as to align and guide the pin into the opening defined by the plurality of collet segments of the connector; and driving the plurality of collet segments to move radially-inwardly to engage the pin of the first riser joint of the riser to form a connection between the riser and the wellhead assembly, the method further comprising:

providing a fluid to a sealed space within collet housing of the connector to drive a piston to move within the collet housing, the collet housing comprising: an outer wall; an inner wall; and an annular space defined between the outer wall and the inner wall, wherein first portions of the plurality of collet segments are positioned to form a ring in the annular space of the collet housing, wherein contact between the piston and the plurality of collet segments as the piston moves within the collet housing causes the plurality of collet segments to move radially-inwardly.

17. The method of claim 16, comprising moving the first riser joint of the riser toward the connector until respective flanges of the first riser joint and the connector contact one another to thereby align the pin of the first riser joint of the riser with the opening defined by the plurality of collet segments of the connector.

18. The method of claim 16, comprising driving the plurality of collet segments to move radially-outwardly to disengage from the pin of the first riser joint of the riser to break up the connection between the riser and the wellhead assembly.

19. The method of claim 18, comprising withdrawing the pin of the first riser joint of the riser to separate the riser from the wellhead assembly.

20. The method of claim 16, wherein second portions of the plurality of collet segments are positioned vertically above the inner wall to enable the second portions of the plurality of collet segments to engage the pin of the first riser joint of the riser.

* * * * *